US006441281B1

(12) United States Patent
Rattner et al.

(10) Patent No.: US 6,441,281 B1
(45) Date of Patent: Aug. 27, 2002

(54) TENSION-RELEASING BRIDGE FOR USE WITH STRINGED MUSICAL INSTRUMENTS

(76) Inventors: Charles A. Rattner, 240 Wardwell St. # 7, Stamford, CT (US) 06902; Michael J. Rattner, 33 Settlers Trail, Stamford, CT (US) 06903

( * ) Notice: Subject to any disclaimer, the term of this patent is extended or adjusted under 35 U.S.C. 154(b) by 0 days.

(21) Appl. No.: 09/495,047

(22) Filed: Jan. 31, 2000

(51) Int. Cl.[7] ..... G10D 3/04
(52) U.S. Cl. ..... 84/298; 84/299
(58) Field of Search ..... 84/298, 297 R, 84/299, 307, 312 R

(56) References Cited

U.S. PATENT DOCUMENTS 4,171,661 A 10/1979 Rose
4,608,905 A 9/1986 Takabayashi
4,638,711 A * 1/1987 Stroh ..... 84/298
4,672,877 A 6/1987 Hoshino et al.
4,763,555 A * 8/1988 Minakuchi et al. ..... 84/313
4,770,079 A 9/1988 Mastroianni
5,413,019 A 5/1995 Blanda, Jr.
5,419,227 A * 5/1995 Lavineway ..... 84/313
6,133,515 A * 10/2000 Hoshino ..... 84/307

* cited by examiner

*Primary Examiner*—Robert E. Nappi
*Assistant Examiner*—Kim Lockett
(74) *Attorney, Agent, or Firm*—Charles Rattner

(57) ABSTRACT

A bridge is releasably mountable on a stringed musical instrument and used in conjunction with a release mechanism such that when the release mechanism is activated, the distance between one end of a string being held by the bridge and a second end of the string secured elsewhere on the musical instrument is decreased, thereby decreasing the tension on the instrument caused by the tuning of the string.

20 Claims, 9 Drawing Sheets

TENSION-RELEASING BRIDGE FOR USE WITH STRINGED MUSICAL INSTRUMENTS

FIELD OF THE INVENTION

This invention relates generally to music equipment and musical instruments and relates more particularly to bridges cooperating with a string tension releasing mechanism, including bridges on sounding boards, inverted bridges, bridges with string clamps or string holders, guitar bridges, and guitar bridges with tailpieces.

BACKGROUND OF THE INVENTION

In a typical useful configuration, stringed musical instruments comprise a body, a neck, a head and a plurality of tuned strings. A standard neck is flat and is comprised of one or more types of wood, such as maple or rosewood. The head is attached to a first end of the neck and comprises one or more tuning pegs that hold the ends of the strings and accommodate the tuning thereof. The body is attached to an opposite end of the neck and comprises a bridge that is securely fastened to its upper face. The bridge secures the opposite ends of the strings to the body of the instrument. The strings are then tuned with the tuning pegs to resonate particular acoustic frequencies upon being plucked, strummed or otherwise disturbed.

Tuned strings create a tensile force across the neck. e.g. between the head and the body. Over time, this constant force may cause the neck of the instrument to bow or warp. When this happens the neck of the instrument is no longer flat. This condition adversely affects the tuning and intonation of the instrument over time. Additionally, the instrument becomes more difficult to play because the distance between the strings and the outer face of the neck typically becomes non-uniform with respect to the instrument's original structural and ornamental design. To correct this problem, the neck of the instrument must either be straightened or replaced. Either of these repairs are costly and must be performed as often as once a year.

It is possible to avoid damage to the neck by de-tuning the strings after each use of the instrument. However, stringed musical instruments may comprise or cooperate with as many as twelve strings. Hence, re-tuning each string before each use of an instrument can be very tedious. Because of this, many musicians choose not to de-tune the strings on their instruments after each use, thus allowing the progression of neck warping.

In order to avoid costly repairs and maintenance, it is desirable to introduce a device for a stringed musical instrument which prevents warping of the neck while allowing the strings to stay substantially tuned. It is further desirable that such device does not affect the quality of sound produced by the instrument due to its use. It is further desirable to make such a device mountable on pre-existing models of stringed instruments as well as on future models which may or may not contemplate the use of the device, so that all stringed instruments may be so equipped.

BRIEF SUMMARY OF THE INVENTION

In order to address the problems of the prior art, a bridge system of the present invention is introduced which may be mountable on a stringed musical instrument having a body and a neck. The bridge system includes a bridge having a first end and a second end and a hinge operatively connected to the first end.

According to a further embodiment, a bridge system of the present invention may be mountable on a stringed musical instrument having a neck and a body. The bridge system includes a bridge having a first end and a second, wherein the first end is disposed closer to a neck than the second end. The bridge system further includes a holder for securing a plurality of strings and a guide for attaching the bridge to at least one rail.

According to a still further embodiment of the present invention a bridge system which may be mounted on a musical instrument having a body and a neck includes an end operatively connected to at least one spring mountable on the body. The at least one spring is positioned between the bridge and the body.

In certain embodiments it is contemplated that, in accordance with the instant invention a bridge of, for example, a stringed musical instrument may preferably be equipped to hold the ends of one or more strings of said instrument. The bridge may be releasably mounted to the body of the musical instrument such that when a release mechanism is activated, the tension of the strings may be reduced or eliminated. The bridge may not completely detach from the body of the instrument, but rather, may be repositioned so that the distance between the top and bottom of the one or more strings as measured along the body of the instrument may be decreased. The bridge may be returned to its original position by manual depression when desired such that the one or more strings may be substantially returned to their original tuning. In certain embodiments it is contemplated that, in accordance with the instant invention, while a bridge is in its released position, there may be little or no tensile force between the top of the neck and the body. In this manner, the progression of neck warping due to the tensile force is greatly reduced.

It is, therefore, an advantage of certain embodiments of the instant invention that a bridge for a musical instrument is provided which allows for the release at least one string's tension between the neck and the body of a stringed musical instrument so as to reduce damage to the neck of the instrument over time.

It is a further advantage of certain embodiments of the instant invention that a bridge can manually be returned to its original position after release so that the at least one string's tension between the neck and body is substantially restored.

It is a still further advantage a bridge of the present invention may be incorporated into any model of previously existing stringed musical instruments.

BRIEF DESCRIPTION OF THE DRAWINGS

Additional objects and advantages of the invention will become apparent to those of ordinary skill in the art from the detailed description of the invention provided below, in conjunction with the figures provided therewith, of which.

DETAILED DESCRIPTION OF THE EMBODIMENT

Figure 1:
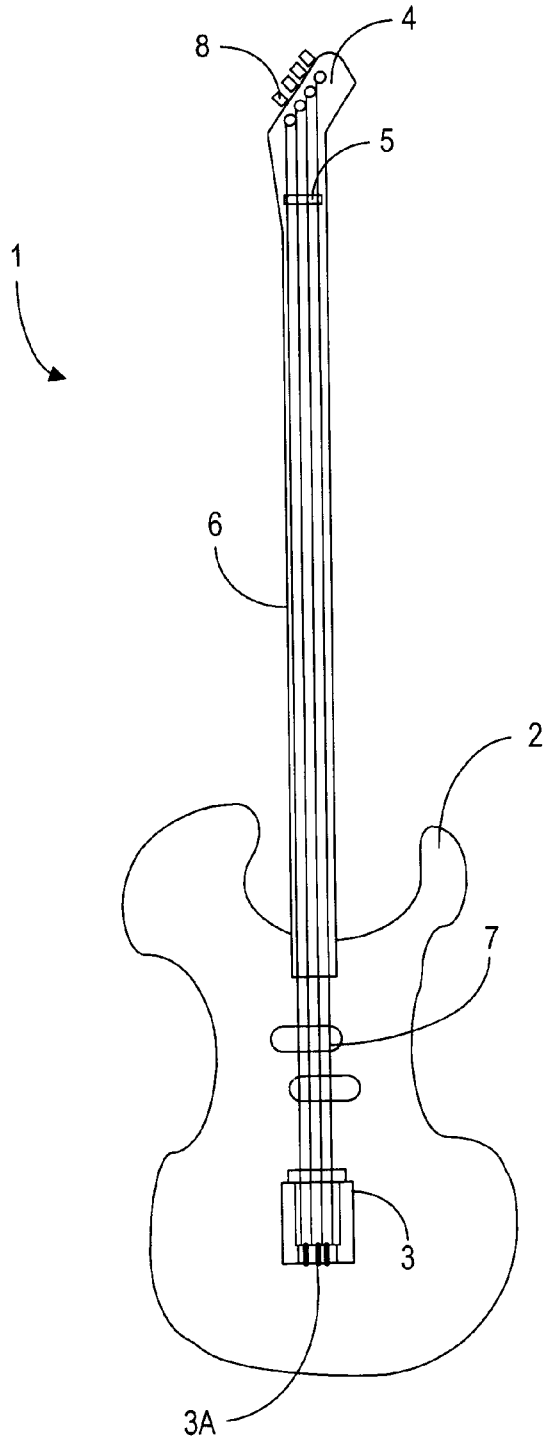
FIG. 1 is a front view of a stringed musical instrument illustrating a secured position of a bridge on a stringed musical instrument.

Referring now to FIGS. 1–8 wherein similar elements are numbered in like manner, FIG. 1 depicts a stringed musical instrument 1 having a body 2 for supporting a bridge 3. The bridge 3 may optionally include a string holder 3A. A head 4 includes a nut 5 for guiding a plurality of strings 7 which have first ends secured to a plurality of tuning pegs and knobs 8. A neck 6 is disposed between the head 4 and the body 2. When certain positions, such as frets (not shown) on the neck 6 are selected by a player of the instrument, the plurality of strings 7 may resonate at desired frequencies.

Although musical instrument 1 is depicted as a guitar, it should be appreciated that the instrument 1 may be any stringed musical instrument having similar components, such as a cello, a violin, a bass guitar, a banjo and the like, wherein the strings of the instrument produce a tensile force between the head 4 and body 2 of the instrument when the plurality of strings 7 are tightened or tuned.

The appearance of the bridge 3 in FIG. 1 corresponds to that of bridges well known in the prior art or to a bridge of the instant invention wherein the bridge 3 is in a secured position on the body 2, as described further below with respect to FIGS. 4–8.

Figure 2:
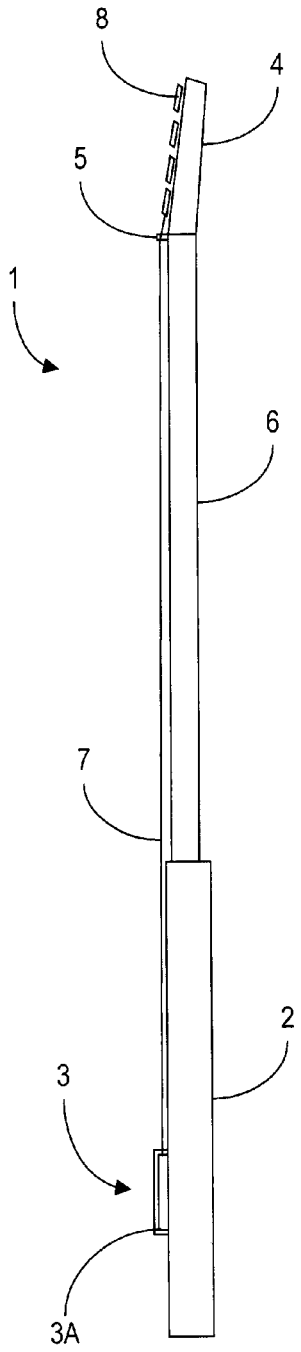
FIG. 2 PRIOR ART
FIG. 2 is a side view of a bridge in a secured position on a prior art musical instrument.

Turning now to FIG. 2, therein is depicted a side view of a prior art musical instrument 1 having the components described immediately above with respect to FIG. 1. In a new condition, the neck 6 of the instrument 1 is substantially flat.

Figure 3:
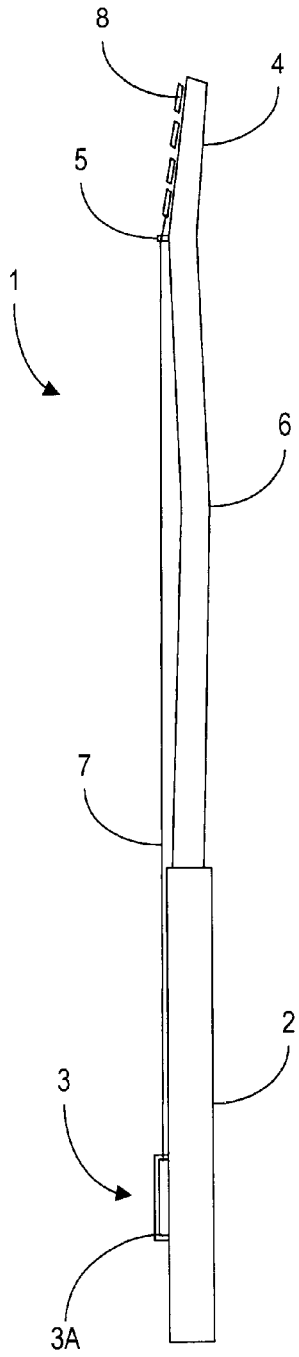
FIG. 3 PRIOR ART
FIG. 3 is a side view of the prior art musical instrument of FIG. 2 illustrating a position of a bridge attached to said instrument and the neck warping which may result therefrom.

FIG. 3 depicts the musical instrument 1 of FIG. 2 wherein the tensile force created by the tuned strings 7 disposed between the head 4 and the body 2 causes the neck 6 to bend or warp. As depicted in FIG. 3, the distance between the plurality of strings 7 and the neck 6 is no longer uniform, making the instrument more difficult to play and affecting the intonation of the instrument 1.

Figure 4:
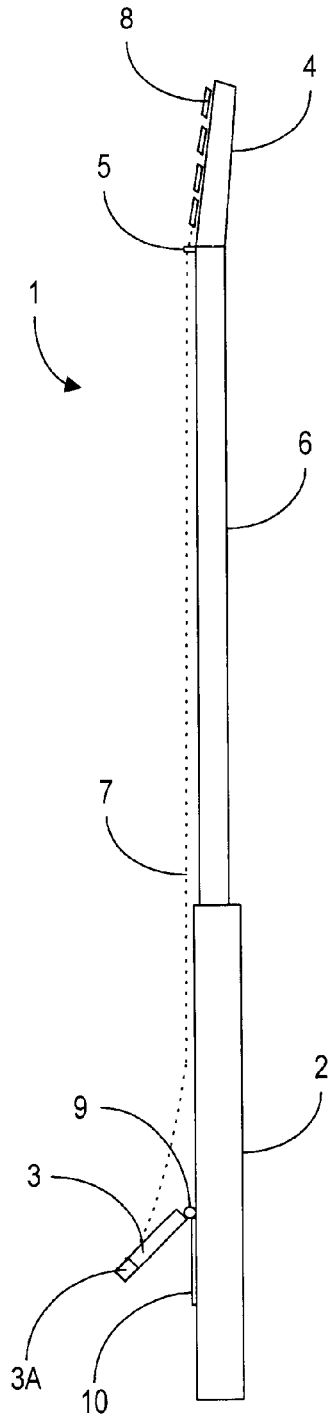
FIG. 4 is a side view of a musical instrument illustrating the position of a released bridge in accordance with one embodiment of the instant invention.

Referring now to FIG. 4, therein is depicted a bridge system 11 according to one embodiment of the instant invention. The bridge system 11 includes a bridge 3, a holder 3A for a plurality of strings 7, a hinge 9 and a plate 10. The bridge 3 may be any bridge which is operatively connectable to a hinge 9 or any portion thereofThe hinge 9 may be any known hinge, a portion of a hinge or similar device which allows the bridge 3 to move between a first position (wherein the bridge is secured to the body 2) and second position (wherein an end of the bridge 3 is released from the body 2 as shown). The plate 10 may be any durable material, such as a metal, which may be operatively connected to the hinge 9, or a portion thereof The plate 10 serves to secure an end of the bridge 3 to the body 2 when the bridge 3 is in the released position as shown. Alternatively, the plate 10 may be omitted, in which case the bridge 3 may be operatively connected to the hinge 9, which in turn may be secured directly to the body 2.

Although the bridge system 11 is depicted as being mounted on the body 2, it is to be understood that the bridge may be positioned anywhere on the instrument 1 which is substantially opposite from where an opposite end of the strings 7 are secured. Accordingly, where the instrument is a guitar or the like wherein the the strings 7 are secured and tuned at the body 2, rather than the head 4, the bridge system 11 may be positioned on the head 4. Other embodiments apparent to one of ordinary skill in the art are envisioned to be within the scope and spirit of the present invention.

Figure 5A:
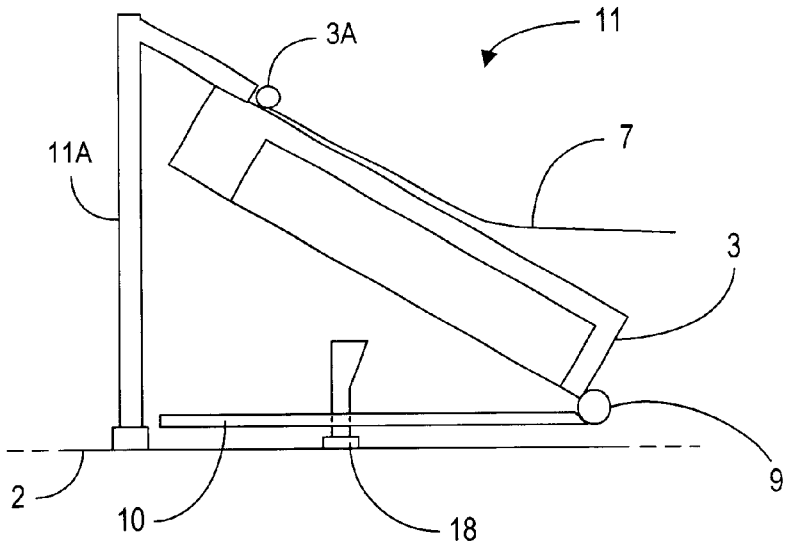
FIG. 5A is a side view of a bridge in cooperation with a catch in accordance with one embodiment of the instant invention.

Turning now to FIG. 5A, therein is depicted a side view of an embodiment of a bridge system 11 which may further include a catch 11A and a release mechanism 18. The release mechanism 18 may be provided with the plate 10 or separately therefrom. When the release mechanism 18 is in a first position, the end of the bridge 3 opposite the hinge 9 is held in a secured position to the body 2. When the release mechanism 18 is moved to a second position, that end of the bridge 3 is released from the body 2 to a second position. This release is caused by the tensile force exerted by the strings 7, such force being between the head 4 and the bridge 3 when secured to the body 2. The released end of the bridge 3 may be released to any operable distance from the body 2. Of course, such length may not physically exceed the length of the bridge 3 and the hinge 9.

Preferably however, the bridge 3 is secured in a second position by the catch 11A at a distance that does not allow the plurality of strings 7 to be unguided by nut 5. Thus, there may be a de minimis tensile force that still exists between the head 4 and body 2 when the bridge is released which is necessary to prevent the strings 7 from becoming unguided. However, such minuscule force will not impact the flatness of neck 6 in as drastic a manner as with instruments of the prior art. Experimentation has revealed that a distance of 0.5 inches between the released end of bridge 3 and body 2 is acceptable.

When a user of instrument 1 wishes to play the instrument after the bridge 3 has been released, the bridge may be manually depressed back into the first position. Experimentation has revealed that if the bridge 3 is in a second position for a brief amount of time, the original tuning of the strings is substantially restored. As the amount of time increases, the tuning of the strings may increasingly deviate from their original tuning.

The release mechanism 18 disclosed above may be any device which accomplishes these above functions. Such devices may include a latch, a spring latch, a release-and-hold device 12 (described further hereinbelow) and the like. When the release mechanism 18 employed is a spring latch, the release mechanism 18 may be actuated to release the bridge 3 by moving the release mechanism between a first and a second position. After the bridge has been released, the spring in the latch may return the release mechanism to its first position. The release mechanism 18 may be provided in any position substantially near the end of bridge 3 that is to be released, but is preferably disposed at any side of the bridge which is parallel to neck 6 so as to avoid interfering with the play of the instrument 1.

The catch 11A is disposed on the body 2 so as to secure the bridge 3 in a second position when the bridge 3 is released to that position after release mechanism 18 has been actuated. The catch 11A may be provided to consumers with the the bridge system 11 or separately therefrom. Furthermore, the catch 11A may be disposed in any location on the body wherein it may secure the bridge 3 to the second position, but is preferably disposed at an end of the bridge 3 substantially opposite in position to the neck 6 so as to avoid interfering with the play of the instrument 1. Any number of catches 11A may be provided.

Figure 5B:
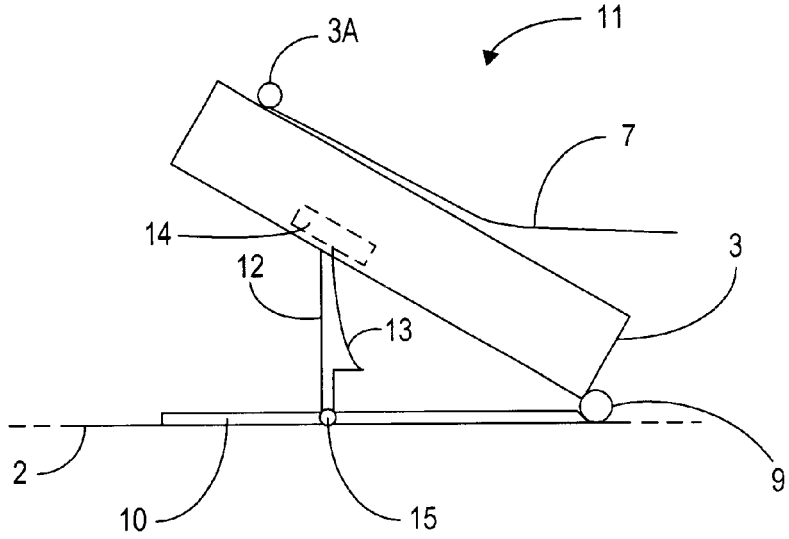
FIG. 5B is a side view of a bridge in cooperation with a release-and-hold device in accordance with one embodiment of the instant invention.

Turning now to FIG. 5B, therein is depicted a side view of a further embodiment of the bridge system 11 wherein the functions of the release mechanism 18 and the catch 11A are performed by the same device 12. The release-and-hold device 12 may be disposed substantially within the bridge 3, which, in turn, must have a hole 17 (described with regard to FIGS. 6, 7A and 7B) to accommodate the device 12. The release-and-hold device 12 is secured to either plate 10, or through an opening (not shown) in plate 10 to the body 2. The end of release-and-hold device 12 is secured by a rotation member 15. Rotation member 15 allows the device 12 to be moved between a first and a second position so that the bridge 3 may be released from a secured position to a released position on the body. The rotation member 15 may be any mechanism for accomplishing this function, and is preferably a spring hinge mechanism wherein the spring returns the device 12 to a first position after being actuated.

When the bridge 3 and the device 12 are both in a first, secured position, a latch 13 holds the bridge 3 in place on the body 2. This may be accomplished by providing a lip (not shown) on the bridge to mate with the latch 13. The device 12, when actuated to a second position holds the bridge 3 in a second, i.e. released, position by a catching member 14. The bridge 3 may be returned to the first position by manually depressing the bridge such that the latch 113 is re-engaged. Catching member 14 thus protrudes from the top of bridge 3 when the bridge 3 is in a secured position and further allows for actuation of the device 12. Latch 13 meets the bottom internal portion of the bridge 3 when the bridge 3 is secured. Catching member 14 meets the top exterior portion of the bridge 3 when the bridge 3 is released to a second position. Catching member 14 may be any device which accomplishes this function and is disposed between the plurality of strings 7 so as to avoid interfering with the play of the instrument 1.

Figure 6:
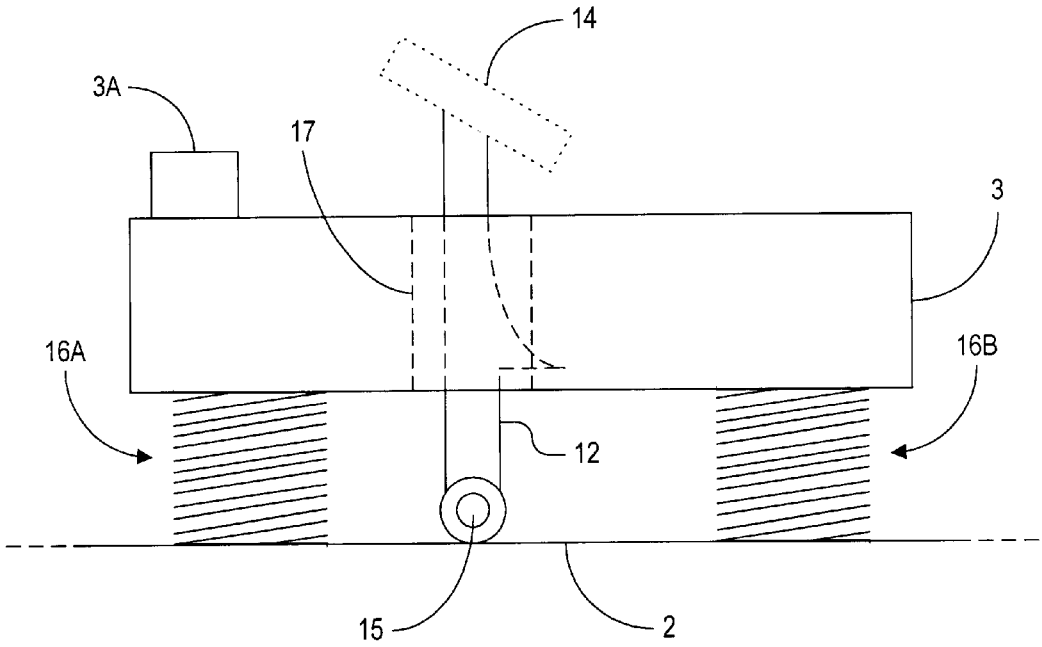
FIG. 6 is a side view of a bridge in cooperation with a spring mechanism in accordance with one embodiment of the instant invention.

Turning now to FIG. 6, therein is depicted a further embodiment of the present invention wherein the bridge 3 is secured to the body 2 by a plurality of springs 16A and 16B. A first end of the springs 16A, 16B are secured to the body 2, or alternatively to, a plate which is secured to the body 2 as shown previously in FIG. 4. The bridge 3 is in a similar configuration to that described with regard to FIG. 5B. That is, there is a hole 17 disposed within the bridge 3 to accommodate a release-and-hold device 12. The release-and-hold device 12 may be actuated by rotating the device 12 from a first position to a second position about rotation member 15. When the device 12 in the first position, the bridge 3 is secured in a first position to the body 2 by the latch 13 and spring 16A and 16B are compressed. When the device 12 is moved to a second position, the bridge 3 is release to a second position, the tensile force is reduced and the springs 16A and 16B are decompressed. The bridge 3 may be returned to a secured position on the body 2 by manually depressing the bridge 3 back to its first position.

Figure 7A:
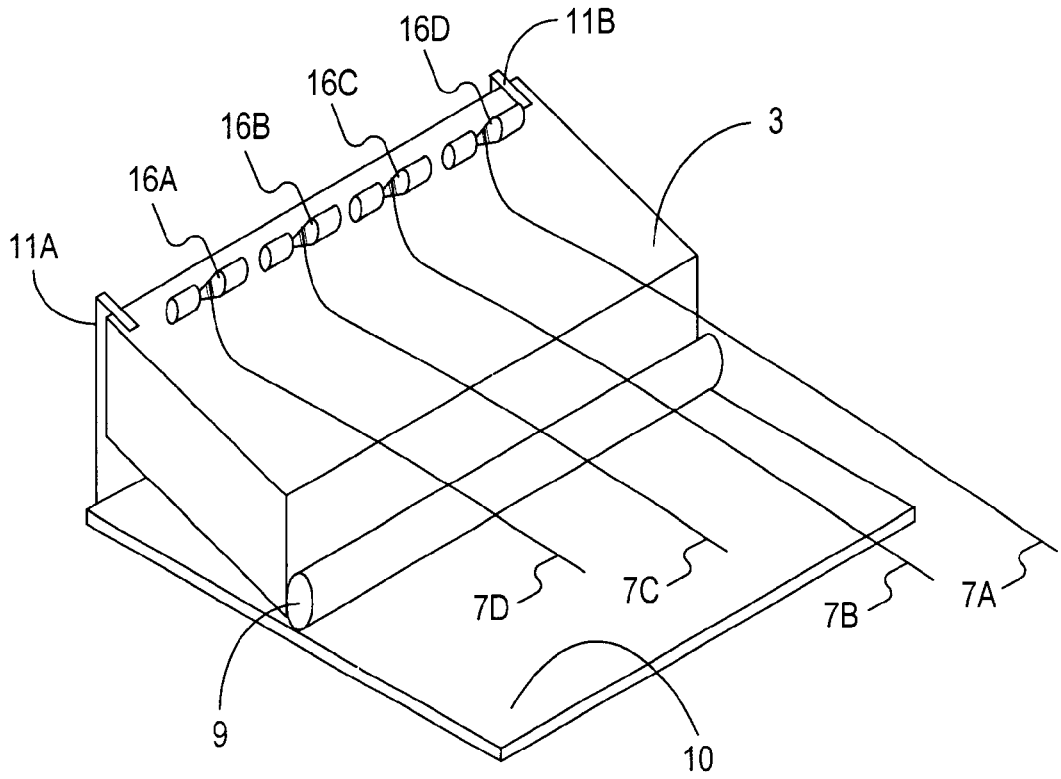
FIG. 7A is a perspective view of a bridge of FIG. 5A.
Figure 7B:
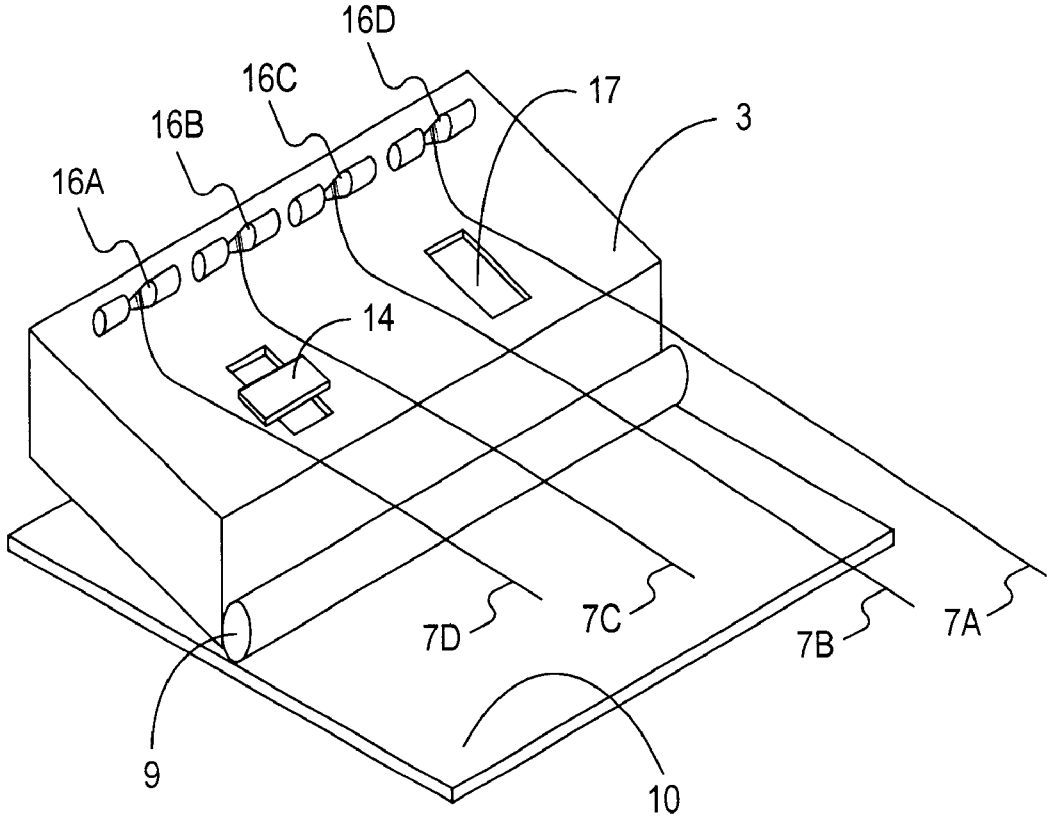
FIG. 7B is a perspective view of a bridge of FIG. 5B.

FIGS. 7A and 7B depict a perspective view of alternate embodiments of the bridge system 11 as displayed in FIGS. 5A and 5B. String holders 3A are depicted individually as elements 16A–16D. A plurality of catches 11A and 11B may be provided therewith as depicted in FIG. 7A. Alternatively, there may be a plurality of release-and-hold devices 12 disposed within a plurality of holes 17, as depicted in FIG. 7B. In the latter embodiment of FIG. 7B, the catching members 14 may be disposed along and within the bridge 3 so as not to interfere with the play of the instrument 1.

Figure 8:
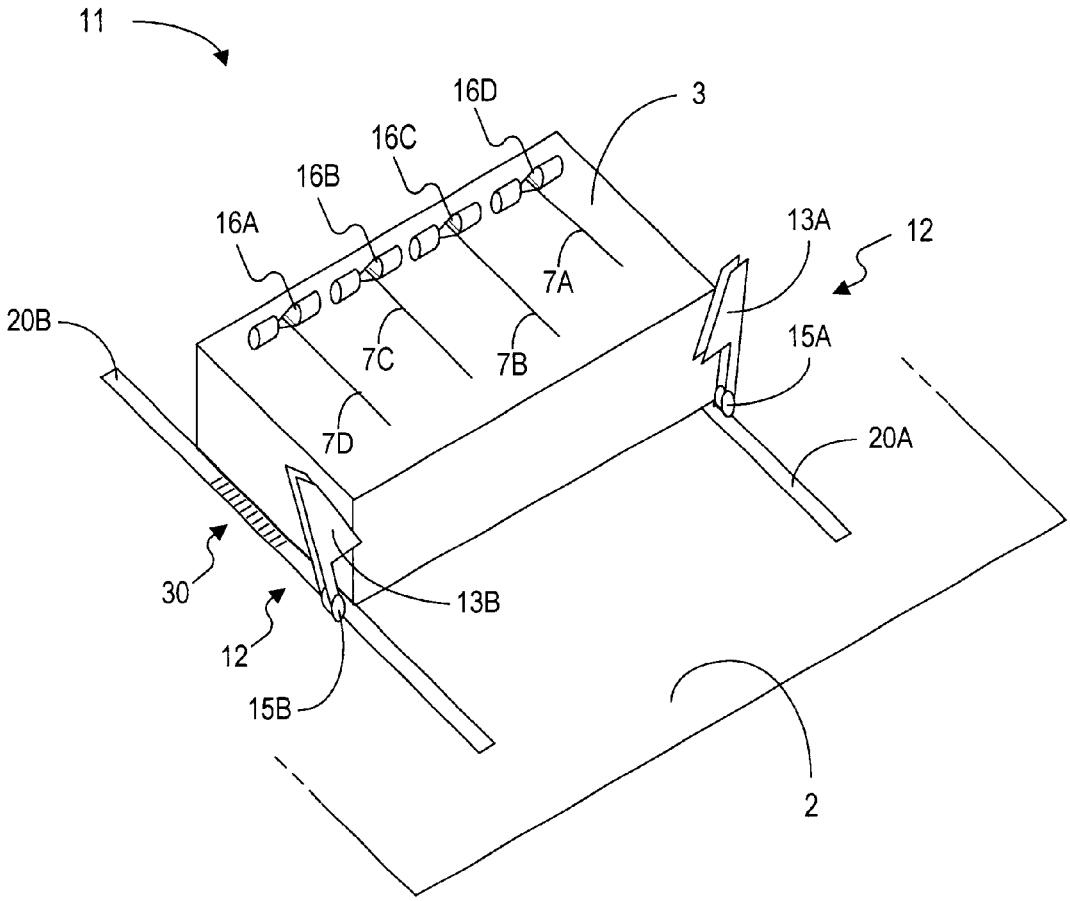
FIG. 8 is a perspective view of a bridge in cooperation with rails in accordance with one embodiment of the instant invention.

A further embodiment of the present invention is depicted in perspective view in FIG. 8. The bridge system 11 includes a bridge 3 which optionally includes string holders 16A–16D, and further has a guide 30 for securing the bridge to a plurality of rails 20A and 20B. The rails 20A, 20B are, in turn, secured to the body 2 of musical instrument 1 on either side of the bridge 3. Alternatively, the rails 20A, 20B may be provided underneath the bridge 3 on the body 2. The bridge 3 is secured in a first position by latches 13A and 13B of release-and-hold devices 12. The devices 12 are in turn secured to body 2 by rotation members 15A and 15B. When the devices 12 are moved from a first position to a second position, the bridge 3 is forced by the tensile force of plurality of strings 7 to move along rails 20A and 20B to a second position wherein the tensile force is decreased. The bridge may be secured in the second position by the end of each of rails 20A and 20B. Alternatively a further catching member (not shown) may be employed to hold the released bridge 3 at a second position in a manner similar to the embodiments discussed above, or in any manner apparent to one of ordinary skill in the art. The bridge 3 may be returned to its first secured position by manually pressing the bridge back into place.

One skilled in the art will appreciate that while the invention has been illustrated in terms of particular embodiments disclosed in the foregoing, other equivalents and embodiments are contemplated to be within the spirit and scope of the present invention. For example, and in accordance with the instant invention, a release mechanism, a catch, a string holder and any individual, necessary or, perhaps, ornamental components are, in any combination, contemplated to be included with a bridge or to be provided separately therefrom. The subject matter disclosed in the foregoing should, therefore, not be construed as solely limiting the spirit and scope of the invention, which are particularly pointed out and distinctly recited by the appended claims.

We claim:

1. A bridge system mountable on a stringed musical instrument having a body, a head and a neck, the bridge system comprising:

a bridge mountable on an upper face of a body of a musical instrument, the bridge including a string holder for holding at least one string disposed between the bridge and a head of the musical instrument;

a hinge operatively connected between the bridge and the upper face of the body, wherein the hinge is disposed toward a first end of the bridge closest to the head for securing the first end of the body; and a release mechanism disposed toward a second end of the bridge opposite the first end for holding the second end of the bridge in a secure position on the body, wherein upon actuation of the release mechanism, a tension of the at least one string causes the second end of the bridge to move rotatably about the hinge from the secure position to a second position in which the tension of the at least one string is substantially decreased, and the bridge must be manually depressed to the secure position to restore the tension.

2. The bridge system of claim 1, further comprising a plate operatively connected to the hinge and mountable between the hinge and the upper face of the body.

3. The bridge system of claim 1, wherein the bridge, the hinge and the release mechanism are mountable on a head of the musical instrument.

4. The bridge system of claim 1, wherein the release mechanism is separately mountable on the body from the bridge.

5. The bridge system of claim 1, wherein the bridge comprises the release mechanism.

6. The bridge system of claim 1, further comprising:

a catch, wherein when the release mechanism is actuated, the second end of the bridge is released from the body and secured by the catch in the second position.

7. The bridge system of claim 6, wherein the release mechanism further comprises the catch.

8. The bridge system of claim 6, wherein the bridge comprises at least one opening and wherein the catch is disposed in the opening.

9. The bridge system of claim 2, wherein the plate includes the release mechanism.

10. A bridge system mountable on a stringed musical instrument having a neck and a body, comprising:

a bridge;

a holder disposed on the bridge for securing at least one string disposed between a neck and a body of a musical instrument;

a guide disposed on the bridge for mating with at least one rail attached to the musical instrument; and a release mechanism in operative connection with the bridge, wherein upon actuation of the release mechanism, a tension of the at least one string causes the bridge to move from a first position on the rail to a second position in which a tension of the at least one string is substantially decreased, and the bridge must be manually depressed to the first position to restore the tension.

11. The bridge system of claim 10, further comprising:

at least one rail mountable on the body wherein when the guide is mated to the at least one rail, the bridge may travel along at least a portion of the at least one rail.

12. The bridge system of claim 10, wherein the release mechanism is provided separately from the bridge.

13. The bridge system of claim 10, wherein the bridge comprises the release mechanism.

14. The bridge system of claim 10, further comprising a catch wherein when the moveable element is placed in the second position, the bridge is secured to the second position on the rail by the catch.

15. The bridge system of claim 11, wherein said at least one rail comprises two rails disposed on opposite ends of the bridge and substantially parallel to a neck of the instrument.

16. A bridge system mountable on a musical instrument having a body and a neck, the bridge system comprising:

a bridge operatively connected to at least one spring mountable on the body, the at least one spring for positioning between a bottom of the bridge and an upper face of the body; and a release mechanism disposed to secure the bridge to the body, wherein upon actuation of the release mechanism, a tension of the at least one string and a decompressing force of the spring cause the bridge to move from a secure position on the body to a second position in which a tension of the at least one string is substantially decreased, and the bridge must be manually depressed to the secure position to restore the tension.

17. The bridge system of claim 16, further comprising:

a catch mountable on the body, wherein when the release mechanism is actuated, the bridge is secured in a second position where the tension is substantially decreased by the catch.

18. A method for decreasing string tension of a string mounted between a head and a bridge mounted on a body of a musical instrument, the method comprising:

securing an end of a bridge in a first position relative to a face of a musical instrument; and activating a release mechanism in communication with the end, wherein a tension of the string causes the end of the bridge to move from the first position on the body to a second position in which the tension of the string is substantially decreased.

19. The method of claim 18, further comprising:

manually depressing the end of the bridge from the second position to the first position, thereby substantially restoring the string tension.

20. The method of claim 18, further comprising:

securing the bridge in the second position by a catch.

* * * * *